United States Patent [19]

Hooker

[11] 4,227,334

[45] * Oct. 14, 1980

[54] POLYHEDRAL ANNULAR STRUCTURES, AND BLANKS THEREFOR

[76] Inventor: Rea F. Hooker, 170 W. 74 St., New York, N.Y. 10023

[ * ] Notice: The portion of the term of this patent subsequent to Jan. 11, 1994, has been disclaimed.

[21] Appl. No.: 868,328

[22] Filed: Jan. 10, 1978

[51] Int. Cl.[3] ..... A63H 33/16

[52] U.S. Cl. ..... 46/1 L; 52/81; 52/DIG. 10; 93/84 R

[58] Field of Search ..... 46/1 L, 21; 52/86, 81, 52/DIG. 10; 93/84 R, 84 FF, 84 TW; 428/9

[56] References Cited

U.S. PATENT DOCUMENTS 3,894,352 7/1975 Hooker ..... 46/1 L

FOREIGN PATENT DOCUMENTS 653204 11/1962 Canada ..... 46/1 L

*Primary Examiner*—F. Barry Shay

*Attorney, Agent, or Firm*—Abner Scheffer

[57] ABSTRACT

Folded structures which are polyhedrons of generally toroidal shape, movable to various different stable configurations, made up of a series of hinged trapezoids.

10 Claims, 28 Drawing Figures

POLYHEDRAL ANNULAR STRUCTURES, AND BLANKS THEREFOR

This invention relates to a polyhedral structure which is radially substantially symmetrical about a central axis, said structure comprising a number of planar polygons hinged together at their sides so as to form a continuous multiplanar toroidal web having two edges, which structure can be rotated, about its core, into various different stable configurations each of which is radially substantially symmetrical about said central axis.

Walker U.S. Pat. No. 3,302,321 describes a folded structure which is a polyhedron of generally hexagonal appearance composed of three rows of "interior" isosceles right triangles and two rows of "edge" isosceles triangles. The folded structure can be rotated to make five different stable configurations.

My U.S. Pat. No. 3,894,352 of July 15, 1975 describes folded structures which can be rotated to make six, seven or more different stable configurations, as well as folded structures which can be rotated to make a plurality of different stable configurations of differing heights made with non-isosceles triangles.

My U.S. Pat. No. 4,001,964, Jan. 11, 1977, describes structures made with polygons other than triangles, especially structures in which there are at least three rows of trapezoids.

The present application describes rotable structures made with less than three rows of trapezoids as well as structures made with one or more rows of trapezoids together with one or more rows of triangles.

Several forms of the invention are illustrated in the accompanying drawings which are drawn substantially to scale and in which FIGS. 1,2,3,4,5 and 6 show foldable blanks (or, in FIGS. 3 and 5) portions of blanks;

It will be seen that the illustrated blanks, and polyhedrons made therefrom, are constructed in generally the same manner as described for the blanks and polyhedrons of my U.S. Pat. Nos. 3,894,352 and 4,001,946. However, while my U.S. Pat. No. 4,001,964 specifically describes structures in which there are at least three rows of adjacent trapezoids, FIGS. 1,7,8,9,10 and 11 of the present application show a structure made with only two rows (1 and 2) of trapezoids, which structure can be "rotated" to at least six "stable positions"; the quoted terms are explained in U.S. Pat. No. 3,894,352 and 4,001,964.

Figure 1:
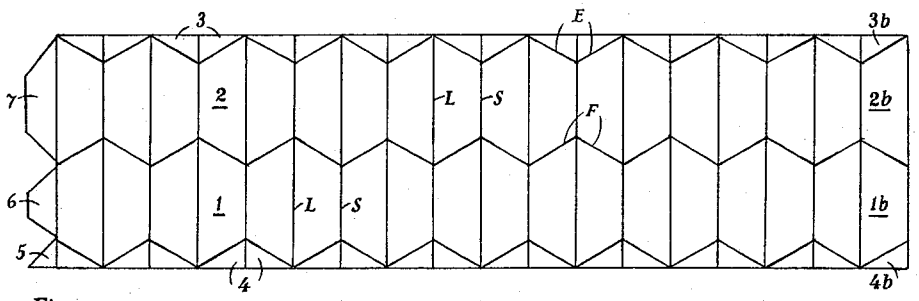

In the blanks shown in FIG. 1 each of the vertical fold lines comprise a short base (S) and a long base (L) of a trapezoid. The portions of those vertical lines which are constituted by the common short sides S of the trapezoids of one row are outfold lines while the portions corresponding to the common longer sides (such as those designated as L) are infold lines.

As in the structures shown in my patents there may be rows of edge triangles such as edge triangles 3 and 4 of FIG. 1, and the blanks have ends which are adapted to be joined together, most conveniently by attaching tabs, such as tabs 5, 6 and 7 (attaching to end edge triangle **4*b* and trapezoid 1*b* and end trapezoid 2*b*** respectively).

It will be understood from the teachings of my patents (whose entire disclosure is incorporated herein by reference) that, for each of the structures illustrated herein, the blank is converted into the polyhedron by first folding the blank along the fold lines (in one direction along infold lines and in the opposite direction along outfold lines), thus forming a flexible tube-like structure and that the resulting flexible folded structure is shaped into circular form and is kept in that form by attaching the tabs at one end thereof to the appropriate polygons indicated above (i.e. tab 7 to end trapezoid **2*b***, etc.) as by adhering the tab to the back of the appropriate polygon.

In the blank shown in FIG. 1 there are 18 trapezoids per row, as shown.

Figure 2:
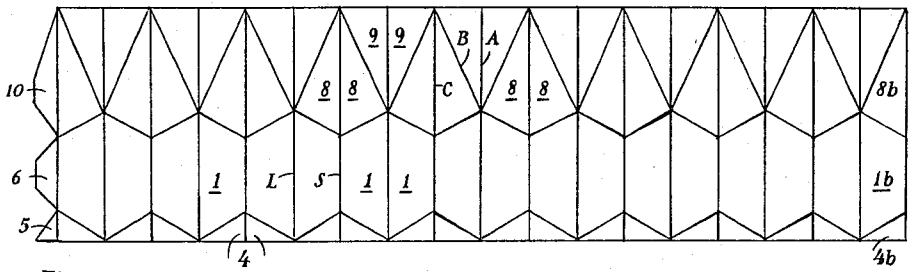

FIGS. 2 and 12–16 show a structure made with one row of trapezoids 1 and another row of triangles 8 (together with rows of edge triangles 4 and 9). The folding direction alternates along the length of the "vertical" fold lines. The portions of those vertical lines which are constituted by the common short sides S of the trapezoids of one row are outfold lines while the portions corresponding to the common longer sides (such as those designated as L) are infold lines. The portions which are constituted by the common sides of the triangles C are infold lines. When, as preferred, there are edge triangles, the common sides of the edge triangles of each row are infold lines. In FIG. 2 there are 18 trapezoids 1 and, similarly, 18 of each of the other elements, in each row, plus the attaching tabs; the structure forms five stable positions.

Figure 3:
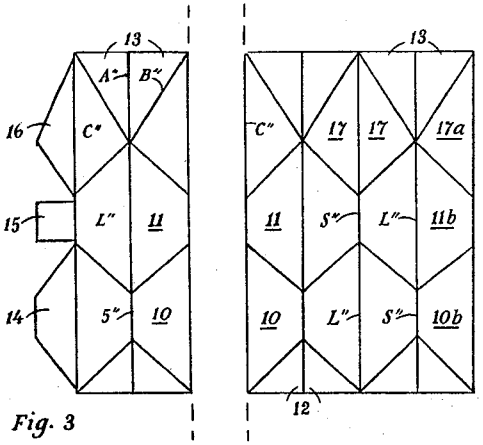
Figure 4:
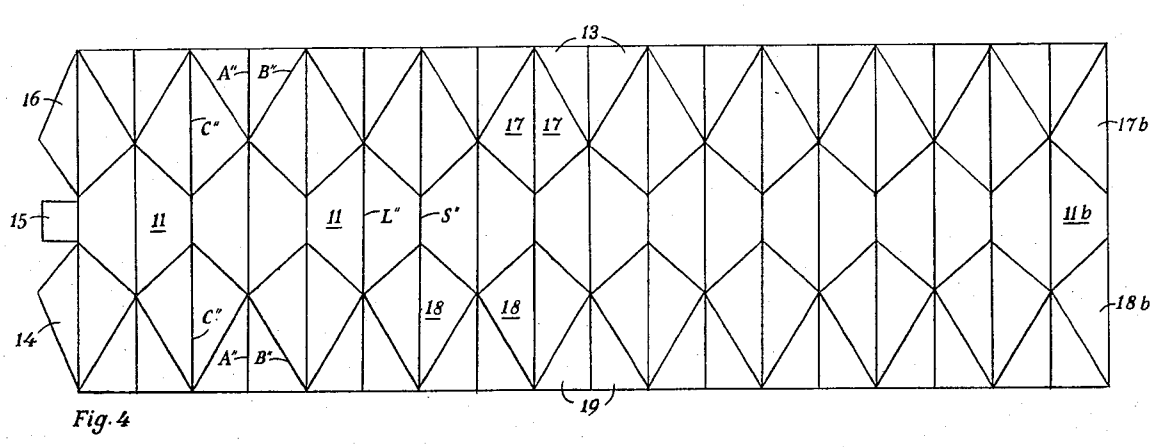
Figure 5:
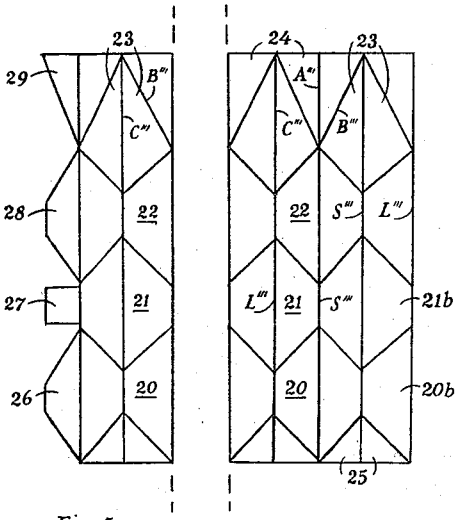
Figure 6:
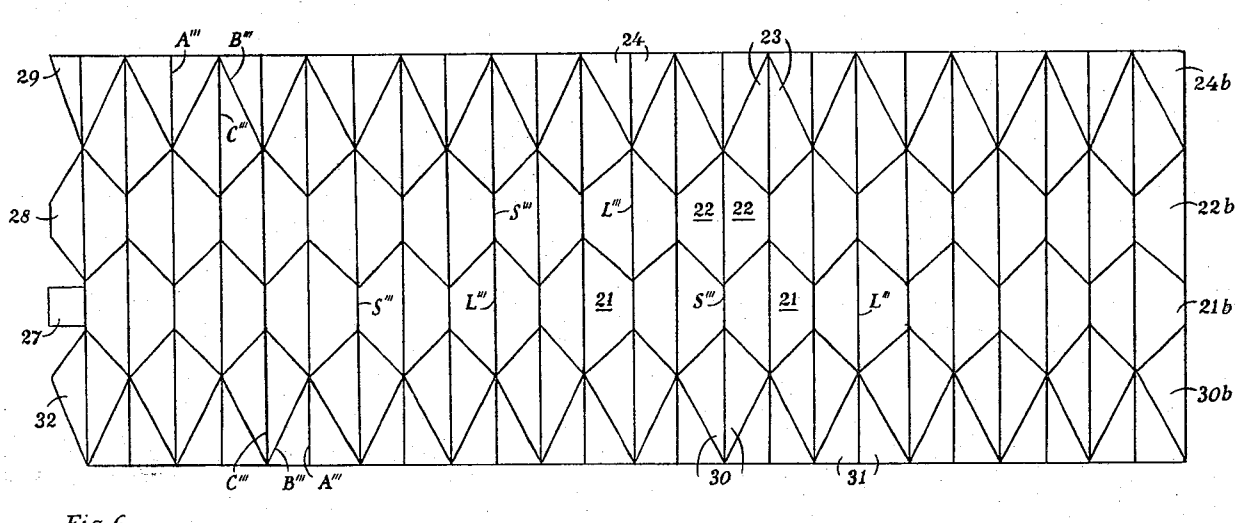
Figure 7:
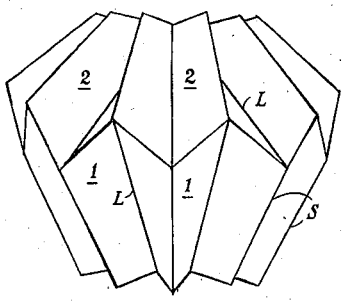
FIGS. 7,8,9,10 and 11 show various forms of a structure made from the blank of FIG. 1.
Figure 8:
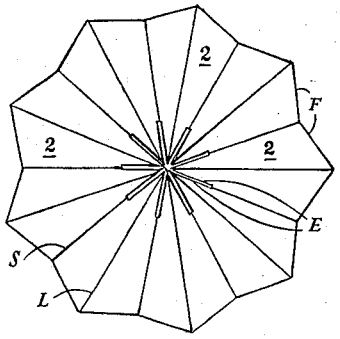
Figure 9:
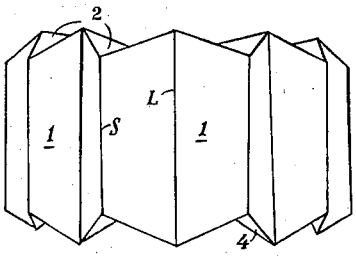
Figure 10:
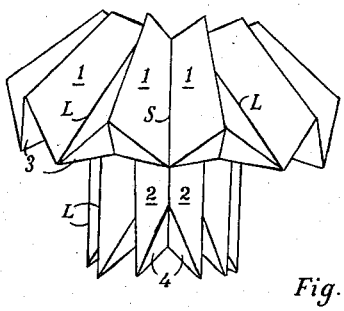
Figure 11:
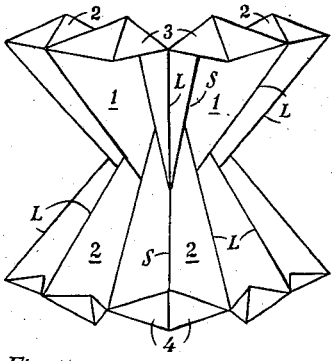
Figure 12:
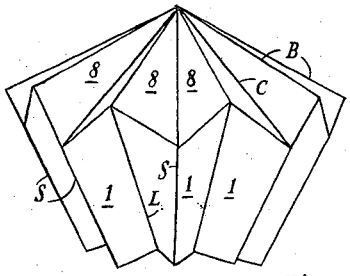
FIGS. 12–16 show various forms of a structure made from the blank of FIG. 2.
Figure 13:
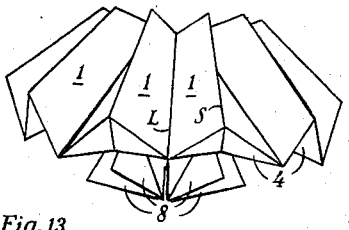
Figure 14:
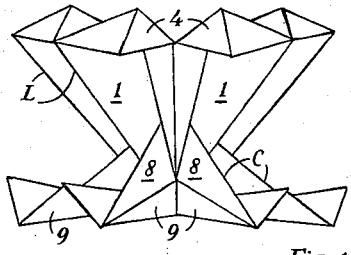
Figure 15:
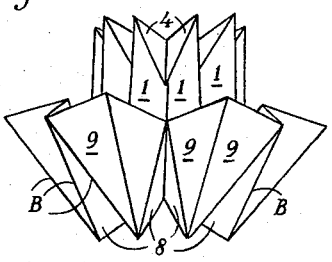
Figure 16:
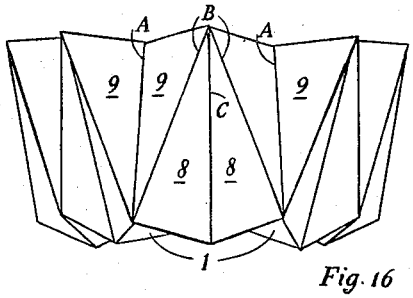
Figure 17:
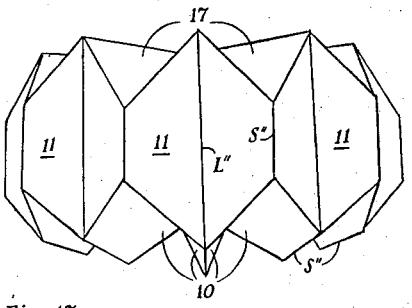
FIGS. 17–19 show various forms of a structure made from the blank of FIG. 3.
Figure 18:
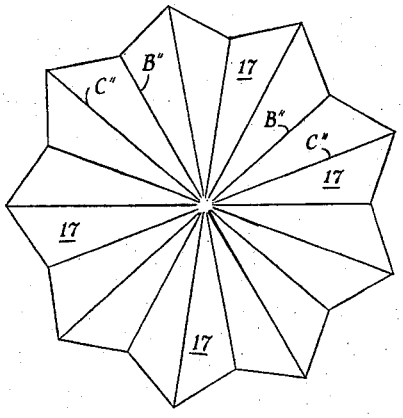
Figure 19:
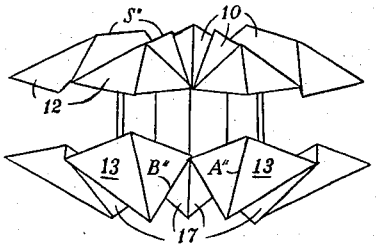
Figure 20:
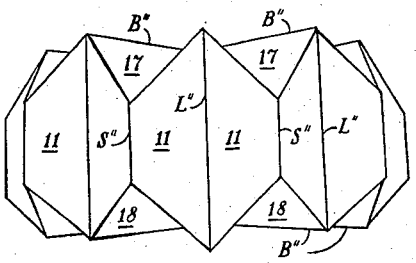
FIGS. 20–22 show various forms of a structure made from the blank of FIG. 4.
Figure 21:
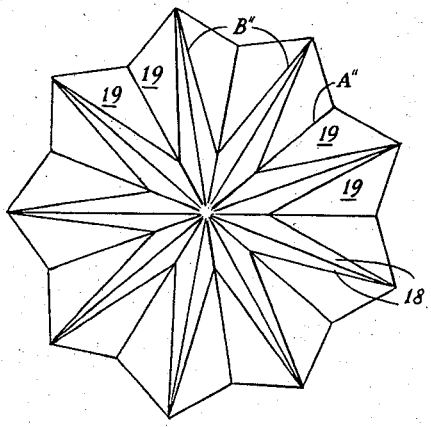
Figure 22:
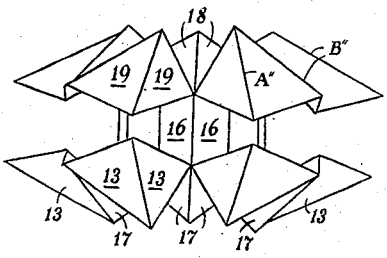
Figure 23:
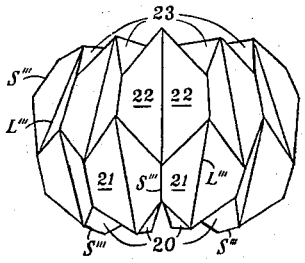
FIGS. 23–25 show various forms of a structure made from the blank of FIG. 5.
Figure 26:
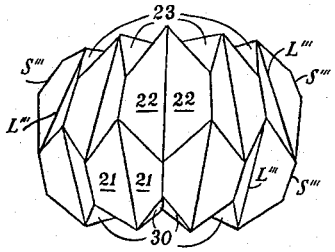
FIGS. 26–28 show various forms of a structure made from the blank of FIG. 6.
Figure 24:
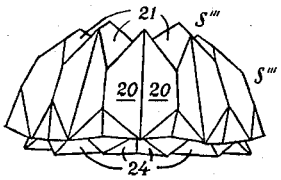
Figure 27:
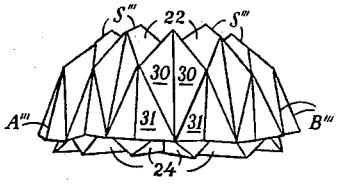
Figure 25:
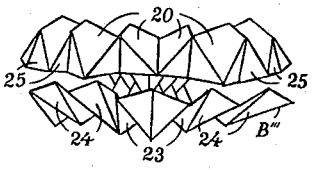
Figure 28:
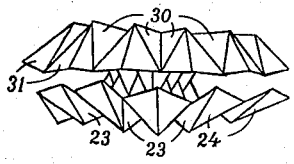

A plurality of rows of trapezoids may be combined with one or more rows of triangles, or vice versa (as illustrated in FIGS. 3 (and 17–19), 4 (and 20–22), 5 (and 23–25) and 6 (and 26–28). Thus in FIGS. 3 and 17–19 there are two rows of trapezoids 11, 10, plus a row of irregular triangles 17. In FIGS. 4 and 20–22 there are two rows of irregular triangles 17, 18 separated by one row of trapezoids 11; in FIGS. 5 and 23–25 there are three rows 22, 21, 20 of trapezoids and one row 23 of irregular triangles, while in FIGS. 6 and 26–28 there are two rows of trapezoids 22, 21 and two rows of irregular triangles 23, 30. In each case there are, preferably, rows of edge triangles (such as 13, 12 in FIG. 3; 13, 19 in FIG. 4; 24, 25 in FIG. 5; and 24, 31 in FIG. 6). The vertical fold lines are folded, as previously described, in an alternating pattern (infold and outfold lines being indicated, respectively by the legends "in" and "out"). In the structure of FIGS. 3 and 17–19 there are 18 elements in each row (e.g. 18 trapezoids, and 18 triangles) and the structure forms some seven stable positions. In the structure of FIGS. 4 and 20–22 there are 18 elements in each row, forming some six stable positions; for FIGS. 5 (and 23–25) there are 24 elements in each row, forming some nine stable positions; for FIGS. 6 (and 26–28) there are 24 elements in each row, forming some eight stable positions.

Various modifications may be used, as in my U.S. Pat. No. 3,894,352. Thus the edge triangles may be altered in shape as in FIGS. 1A, 1B, 1C, 1D and 1E of my parent patent, or omitted. The trapezoids (and edge triangles) may have apertures or windows. The blanks need not be rectangular but rather have, say, broken diagonal ends, which ends may then be joined together in any suitable manner as by means of attaching tabs. Different materials of construction, colors and textures may be employed, as described in U.S. Pat. No. 3,894,352, and the products are suitable for the uses listed therein.

While the elements (trapezoids and triangles) in the blanks are flat planar forms, they often assume warped configurations in the rotatable structures. Thus each of the trapezoids 1 is in a substantially flat planar configuration when the structure is in the stable position shown in FIG. 9, but is quite warped when the position is that shown in FIG. 7. In the positions which cause warping the originally parallel identical trapezoidal elements are placed in non-parallel relationship. This can be seen in the structure in FIG. 8 in which the inner sides E of the trapezoids 2 converge while their outer sides F diverge; this causes the trapezoids 2 to have a concave curve when viewed from the top, as in FIG. 8. Such warped plane elements are also termed "plane" herein, for convenience.

It is understood that the foregoing detailed description is given merely by way of illustration and that variations may be made therein without departing from the spirit of the invention.

I claim:

1. A polyhedral structure which is radially substantially symmetrical about a central axis, said structure comprising a number of planar trapezoids hinged together at their sides so as to form a continuous multiplanar toroidal web having two edges, which structure can be rotated, about its core, into a plurality of different stable configurations each of which is radially substantially symmetrical about said central axis, said structure comprising plane elements arranged in at least two interfitting rows of adjacent elements, at least one of said rows being a trapezoid-row which is a ring of single trapezoids arranged in alternation so that each trapezoid has a hinged longer side in common with one of its two neighbors of its row and has a hinged shorter side in common with the other of its neighbors of its row, said rows interfitting so that each of said trapezoids of said trapezoid-row has a side in common with a plane element of the adjacent row, the longer and shorter common sides within said trapezoid-row being respectively, infold and outfold hinges arranged within planes which radiate from and include said axis and the sides which adjacent rows have in common being outfold hinges.

2. A structure as in claim 1 in which said interfitting rows include said trapezoid-row and a row comprising trapezoids or triangles interfitting with said trapezoid row.

3. A structure as in claim 2 in which said trapezoid-row is adjacent to an edge of said structure, the trapezoids of said trapezoid-row each have a side adjacent to said edge and the edge-adjacent sides of adjacent trapezoids of said trapezoid-row are connected by a folded web having an infold hinge in one of said radial planes, with outfold hinges at said edge-adjacent sides.

4. A structure as in claim 2 in which there is a triangle-row comprising adjacent single congruent triangles arranged in alternation so that each triangle has a hinged side in common with one of its two neighbors of its row and has an apical point in common with the other of its neighbors of its row, the common sides within said triangle-row being infold hinges, arranged within planes which radiate from and include said axis, said apical points being situated on the intersections of infold and outfold hinges.

5. A flat blank of sheet material, said blank having means, including score lines at which said blank can be folded and edges adapted to be secured together to form a continuous web after said blank is folded at said score lines, for converting said blank to a polyhedral structure which is radially substantially symmetrical about a central axis, said structure comprising a number of planar trapezoids hinged together at their sides so as to form a continuous multiplanar toroidal web having two edges, which structure can be rotated, about its core, into a plurality of different stable configurations each of which is radially substantially symmetrical about said central axis, said structure comprising plane elements arranged in at least two interfitting rows of adjacent elements, at least one of said rows being a trapezoid-row which is a ring of single trapezoids arranged in alternation so that each trapezoid has a hinged longer side in common with one of its two neighbors of its row and has a hinged shorter side in common with the other of its neighbors of its row, said rows interfitting so that each of said trapezoids of said trapezoid-row has a side in common with a plane element of the adjacent row, the longer and shorter common sides within said trapezoid-row being respectively, infold and outfold hinges arranged within planes which radiate from and include said axis and the sides which adjacent rows have in common being outfold hinges.

6. A blank as in claim 5 in which said interfitting rows include said trapezoid-row and a row comprising trapezoids or triangles interfitting with said trapezoid row.

7. A blank as in claim 6 in which said trapezoid-row is adjacent to an edge of said structure, the trapezoids of said trapezoid-row each have a side adjacent to said edge and the edge-adjacent sides of adjacent trapezoids of said trapezoid-row are connected by a folded web having an infold hinge in one of said radial planes, with outfold hinges at said edge-adjacent sides.

8. A blank as in claim 6 in which there is a triangle-row comprising adjacent single congruent triangles arranged in alternation so that each triangle has a hinged side in common with one of its two neighbors of its row and has an apical point in common with the other of its neighbors of its row, the common sides within said triangle-row being infold hinges, arranged within planes which radiate from and include said axis, said apical points being situated on the intersections of infold and outfold hinges.

9. A structure as in claim 1 having only two of said trapezoid-rows in mutually interfitting relationship.

10. A blank as in claim 5 having only two of said trapezoid-rows in mutually interfitting relationship.

* * * * *